United States Patent [19]

Yoshimori

[11] Patent Number: 4,470,902

[45] Date of Patent: Sep. 11, 1984

[54] METHOD AND APPARATUS FOR CLASSIFYING PARTICLES

[76] Inventor: Nobuo Yoshimori, 143, Ozenji, Tama-ku, Kawasaki-shi, Kanagawa-ken, Japan

[21] Appl. No.: 309,472

[22] Filed: Oct. 7, 1981

[30] Foreign Application Priority Data

Sep. 5, 1981 [JP] Japan ..... 56-139971

[51] Int. Cl.[3] ..... B07B 3/00

[52] U.S. Cl. ..... 209/139 A; 209/144; 55/261

[58] Field of Search ..... 209/138, 139 R, 139 A, 209/144; 55/261

[56] References Cited

U.S. PATENT DOCUMENTS

| | | | |
|---|---|---|---|
| 1,723,034 | 8/1929 | Hawley | 55/455 |
| 1,950,069 | 3/1934 | Stein | 209/139 A |
| 2,069,398 | 2/1937 | Wallace | 209/144 |
| 2,294,921 | 9/1942 | Lykken | 209/139 R |
| 3,455,449 | 7/1969 | Nara | 209/139 R |
| 3,670,886 | 6/1972 | Hosokawa et al. | 209/139 A |
| 3,680,695 | 8/1972 | Yoshimori et al. | 209/144 |
| 4,059,507 | 11/1977 | Yoshimori | 209/139 A |
| 4,260,478 | 4/1981 | Hosokawa et al. | 209/144 |
| 4,266,673 | 5/1981 | Haidlen et al. | 209/139 R |

FOREIGN PATENT DOCUMENTS

| | | | |
|---|---|---|---|
| 232866 | 4/1969 | U.S.S.R. | 209/139 A |
| 454939 | 2/1975 | U.S.S.R. | 209/139 A |

*Primary Examiner*—Bernard Nozick

*Attorney, Agent, or Firm*—Birch, Stewart, Kolasch & Birch

[57] ABSTRACT

A mixture of air and particles to be classified is ejected through a nozzle located at a lower portion of a vertical housing to deposit the ejected particles on an inner surface of the housing and to convey separated fine particles by a whirling upward air flow. Air is ejected radially beneath the nozzle to separate fine particles from the particles deposited on the inner wall and to convey upward the separated fine particles by the whirling upward air flow and to cause the coarse particles to fall down to the outside of the housing. A rotating disc with vanes is disposed in an enlarged upper portion of the housing to separate and classify said fine particles from the whirling upward air flow. The air conditioning the remaining fine particles is conveyed to a cyclone separator to separate the remaining fine particles. Preferably, the air discharged from the cyclone separator is circulated again through the housing and the cyclone separator.

14 Claims, 13 Drawing Figures

METHOD AND APPARATUS FOR CLASSIFYING PARTICLES

BACKGROUND OF THE INVENTION

This invention relates to method and apparatus for classifying particles.

Various types of methods and apparatus for classifying particles have been proposed which classify fine particles according to their grain size. Among these prior art methods and apparatus, the one having the following construction can classify at a high efficiency. This type of apparatus comprises a cylindrical housing, a rotary disc including rotating classifying members mounted on the top of the cylindrical housing for classifying fine particles, means for creating a whirling upward flow of air in the cylindrical housing, means for dispersing fine particles to be classified in the upward whirling flow, and means located at the bottom of the cylindrical housing for taking out classified fine particles. With this type of apparatus, since the whole interior of the cylindrical housing is used to classify the particles according to the whirling upward flow and the gravity, fine particles can be efficiently classified according to their grain size. Such a prior art method and apparatus, however, requires independent driving mechanisms for dispersing the fine particles in the whirling upward flow and for classifying the particles, thus complicating the driving mechanism. Furthermore, disposition of various members in the cylindrical housing and movements of such members create turbulence in the classifying air which not only impairs the classifying effect but also increases the running cost.

SUMMARY OF THE INVENTION

Accordingly, it is an object of this invention to provide an improved method and apparatus capable of efficiently classifying particles according to their particle size having a simple construction.

Another object of this invention is to provide an improved method and apparatus capable of efficiently dispersing particles to be classified in the air in a classifying apparatus withut using an independent dispersing device.

According to one aspect of this invention there is provided a method of classifying particles according to their particle size of the type wherein fine particles are separated by fine particle separating means disposed in an upper portion of a vertical cylindrical housing and air containing the remaining fine particles is discharged out of the housing, the particles to be classified being dispersed in a whirling upward flow of air created at a lower portion of the housing for separating coarse particles, and the separated coarse particles are discharged out of the housing from the bottom of the housing, characterized by the steps of supplying upwardly the air together with the particles to be classified, converting the air containing the particles into the whirling upward flow at the lower portion of the housing, radially ejecting air at a portion beneath the whirling upward flow to separate and deposit separated particles on an inner surface of the housing, separating fine particles from the layer of deposited particles with the radially ejected air for conveying upwardly separated fine particles by the whirling upward flow of the air, causing the coarse particles remaining on the inner surface to fall down under gravity, and discharging the fallen coarse particles out of the housing through the bottom thereof.

According to another aspect of this invention, there is provided a particle classifying apparatus of the type wherein a fine particle separating means is provided in an upper portion of a vertical cylindrical housing to discharge air containing the remaining fine particles out of the housing, with means provided at a lower portion of the housing for forming a whirling upward flow of the air in the housing and for separating coarse particles, and means provided at the bottom of the housing for discharging separated coarse particles characterized in that there are provided vertical pipe means which convey upwardly air together with the particles to be classified, whirling upward flow-forming nozzle means concentric with the housing and connected to an upper end of the vertical pipe means, coarse particle classifying means located beneath the whirling flow forming nozzle means and having a larger diameter than the nozzle means, and means for supplying air to the coarse particle classifying means, the air ejected by the coarse particle classifying means being directed to an inner surface of the housing for separating and blowing upwardly fine particles from a layer of particles deposited on the inner surface of the housing.

BRIEF DESCRIPTION OF THE DRAWINGS

Further objects and advantages of the invention can be more fully understood from the following detailed description taken in conjunction with the accompanying drawings, in which.

DESCRIPTION OF THE PREFERRED EMBODIMENTS

Figure 1:
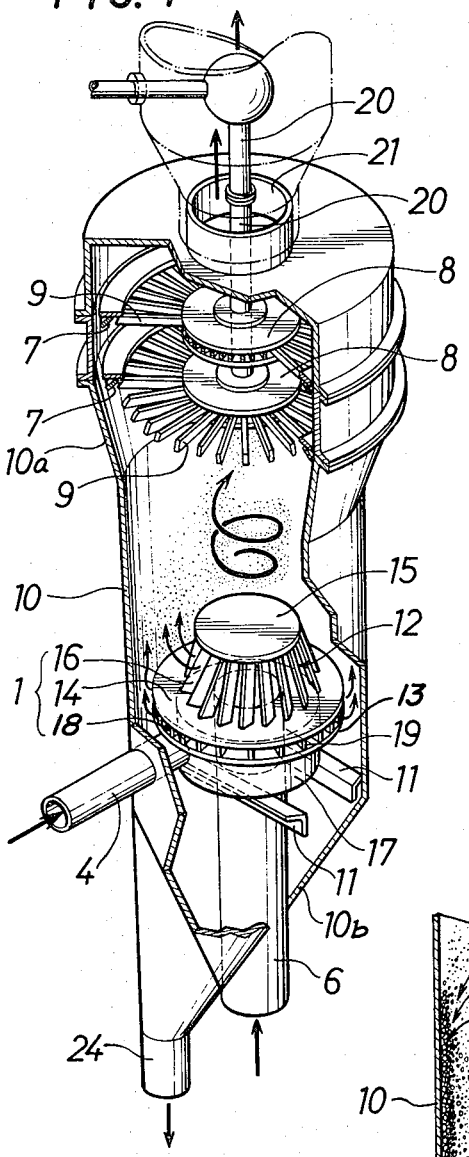
FIG. 1 is a perspective view, partly broken away, showing one embodiment of the classifying apparatus according to this invention.
Figure 2:
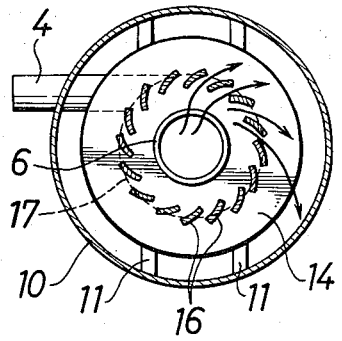
FIG. 2 is a cross-sectional view showing a nozzle for forming a whirling upward flow.
Figure 3:
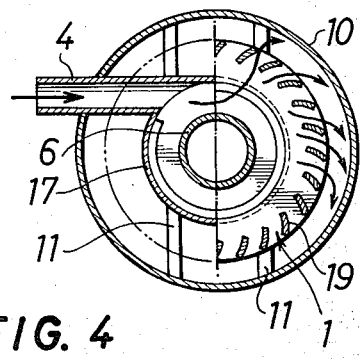
FIG. 3 is a cross-sectional view showing a coarse particle classifying mechanism.

A preferred embodiment of this invention shown in FIGS. 1 through 4 comprises a cylindrical housing 10, transverse supporting beams 11 at the bottom of the housing 10, and an ejection mechanism 1 including a nozzle 12 supported by the supporting beams 11 and adapted to form a whirling air flow as shown in FIG. 2, and a coarse particle classifying mechanism shown in FIG. 3. The upper portion of the cylindrical housing is enlarged as at 10*a* and annular rings 7 are provided for the inner surface of the enlarged portion. Rotary radial classifying vanes 9 are located beneath the respective annular rings 7. The classifying vanes 9 are secured to the peripheries of the discs 8 mounted on a rotary shaft 20 to classify fine particles. The radial classifying vanes 9 may be secured to the peripheries of the discs 8 or pivotally secured thereto such that when the discs 8 rotate the classifying vanes will automatically assume radially extending positions.

Thus, the fine particle classifying mechanism is contained in the top portion of the cylindrical housing and the whirling flow created by the whirling flow forming nozzle 12 rises upwardly in the cylindrical housing. The whirling upward flow disperses and classifies the particles, and fine particles are separated by the rotating classifying vanes 9. Coarse particles are taken out through a discharge pipe 24 attached to one side of the inclined bottom plate 10*b* of the cylindrical housing 10. According to this invention there is provided an upward flow supply pipe 6 which vertically extends through the inclined bottom plate 10*b*, and through the coarse particle classifying mechanism 13, and the upper end of the pipe 6 opens at the central portion of the whirling flow forming nozzle 12. The particles to be classified are supplied into the cylindrical housing 10 through the pipe 6 together with fluid, usually air. The particles are dispersed by the nozzle 12. Coarse particles are classified by the coarse particle classifying mechanism 13 and fall down along the inner surface of the housing 10.

Figure 4:
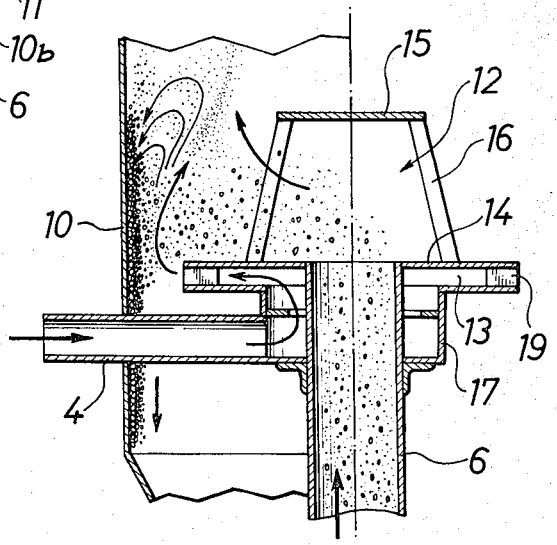
FIG. 4 is a partial longitudinal sectional view showing the nozzle and the coarse particle classifying mechanism shown in FIGS. 2 and 3.

More particularly, an intermediate plate 14 is interposed between the whirling flow forming nozzle 12 and the coarse particle classifying mechanism 13. The whirling flow forming nozzle 12 is provided with a plurality of guide vanes 16 between its top plate 15 and an intermediate plate 14, the guide vanes 16 being equally spaced in the circumferential direction and considerably inclined with respect to the radial direction. Accordingly, the air and the particles contained therein supplied through the pipe 6 pass through the gaps between the guide vanes 16 in directions shown by arrows in FIG. 2. The air thus ejected forms a whirling upward flow along the inner surface of the cylindrical housing 10. As shown in FIG. 1, the diameter of the top plate 15 is smaller than that of the intermediate plate 14. Moreover, as shown in FIGS. 1 and 4, the guide vanes 16 are inclined with respect to the vertical so as to readily form the whirling upward flow.

The coarse particle classifying mechanism 13 disposed beneath the intermediate plate 14 is formed with a distributing chamber 17 at its bottom portion, and air is tangentially blown into the distributing chamber 17 as shown in FIG. 3. through a pipe 4. As shown in FIG. 3, circumferentially spaced guide vanes 19 which are parallel with the guide vanes 16 are disposed between the intermediate plate 14 and a bottom plate 18 which is parallel therewith. As shown, the guide vanes 16 and 19 are suitably curved for controlling the direction of ejection of a mixture of air and particles or air,, respectively.

Figure 5:
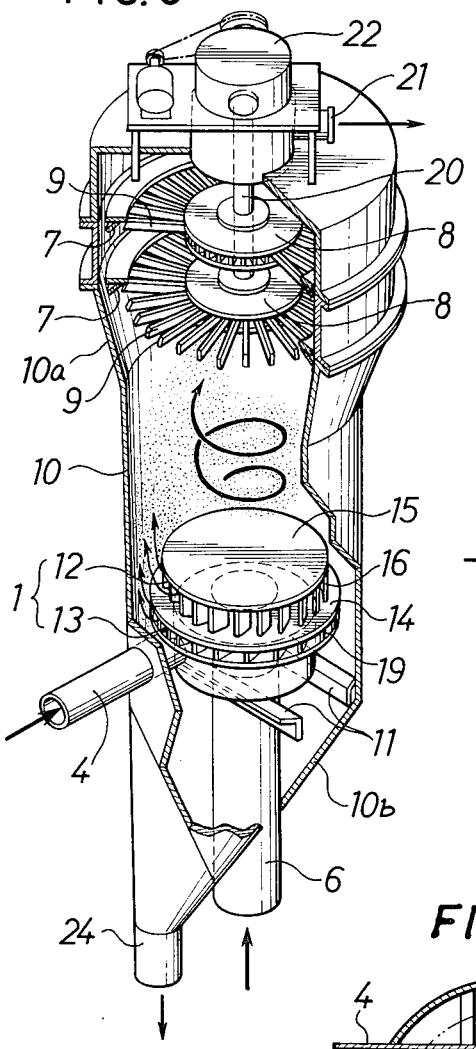
FIG. 5 is a perspective view, partly broken away, showing a modified embodiment of this invention.
Figure 6:
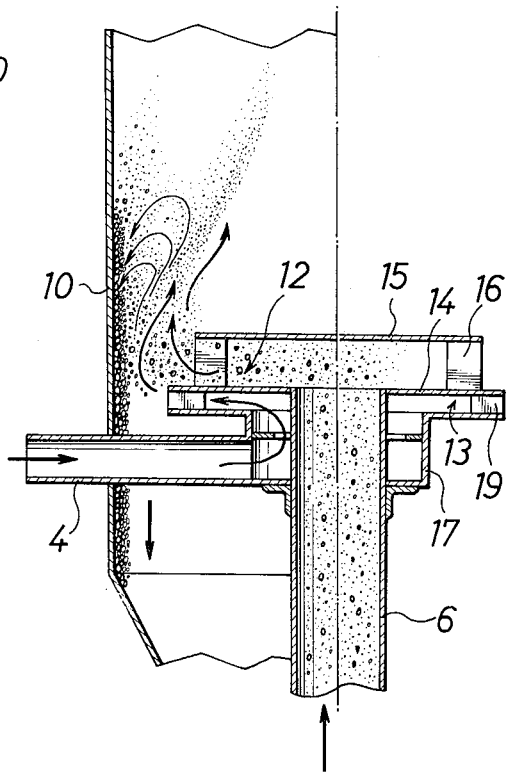
FIG. 6 is a partial vertical view similar to FIG. 4.

The classifying apparatus shown in FIGS. 1 to 4 may be modified as shown in FIGS. 5 and 6. In this modification, the height of the whirling flow forming nozzle 12 is made to be smaller than that shown in FIGS. 1 through 4. Thus, the guide vanes 16 are inclined only with respect to the radial direction and are not inclined with respect to the vertical. A fine particle discharge pipe 21 is bent at right angles and driving means 22, for example an electric motor, is mounted on the discharge pipe 21 for rotating the discs 8. The other mechanisms are identical to those shown in FIGS. 1 through 4.

Figure 7:
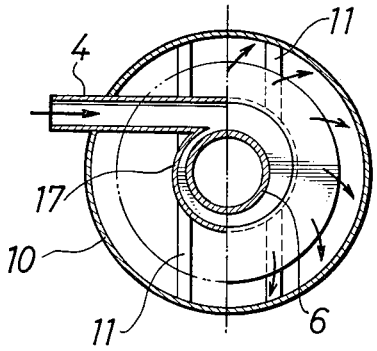
FIG. 7 is a cross-sectional view showing another embodiment of this invention in which both halves are cut at different levels.
Figure 8:
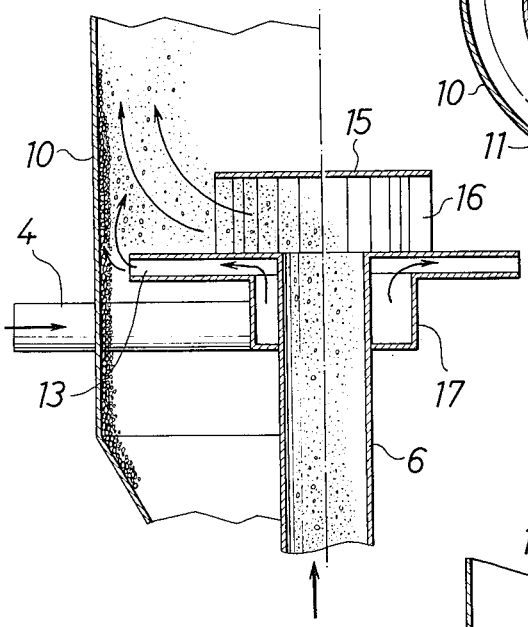
FIG. 8 is a partial longitudinal sectional view showing the modified embodiment shown in FIG. 7.

In the embodiment shown in FIGS. 1 through 6, the guide vanes of the coarse particle classifying mechanism may be omitted. Such simplified construction is shown in FIGS. 7 and 8, in which the pipe 4 admits air tangentially into the distribution chamber 17 which is disposed eccentrically with respect to the pipe 6 so that the radial sectional area of the distribution chamber decreases gradually from the inlet opening of the pipe 4. With this construction, the admitted air whirls in the distribution chamber and then radially blown outwardly through an annular opening 13 connected to the upper periphery of the distributing chamber 17. The eccentric arrangement of the distributing chamber 17 about the central pipe 6 ensures uniform discharge of the air throughout the entire periphery of the distributing chamber 17.

Figure 9:
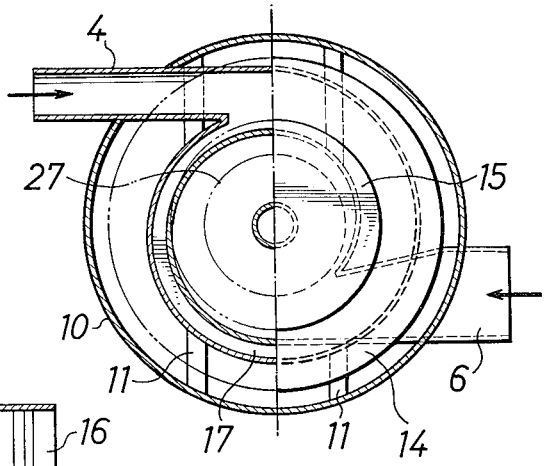
FIG. 9 is a cross-sectional view similar to FIG. 7 and showing still another embodiment of this invention.
Figure 10:
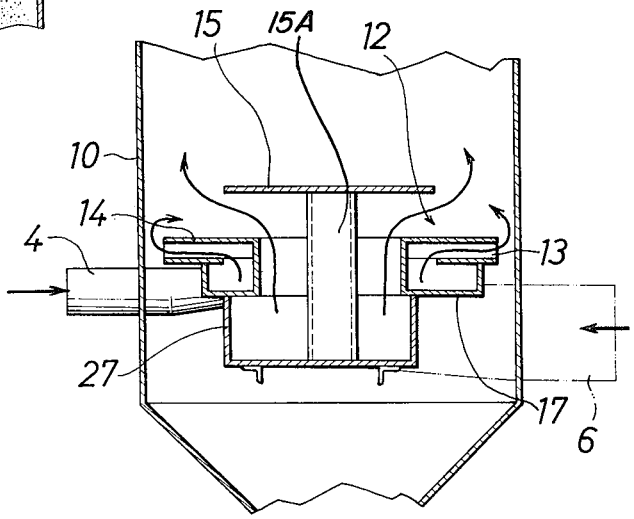
FIG. 10 is a partial vertical sectional view similar to FIG. 8.

Also the guide vanes 16 may be omitted from the whirling flow forming nozzle 12. In still another modification of this invention shown in FIGS. 9 and 10, both guide vanes 16 and 19 of the whirling flow forming nozzle 12 and of the coarse particle classifying mechanism 13 are omitted. In this modification another distributing chamber 27 is added beneath the distributing chamber 17 and a pipe 6 for admitting a mixture of air and particles to be classified is tangentially connected to the additional distributing chamber 27. The radial sectional area of the distributing chamber 27 is also gradually decreased, in other words, the additional distributing chamber 27 is eccentrically disposed with respect to a central post 15*a* that supports the top plate so as to uniformly discharge the whirling flow of the mixture through an annular opening beneath the top plate 15, as shown by arrows.

Elimination of the guide vanes 16 and 19 not only simplifies the construction but also decreases pressure loss of the air and makes the flow thereof smoother.

Figure 11:
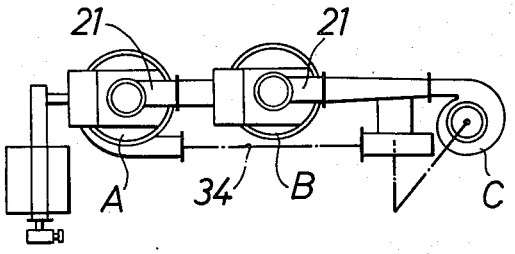
FIG. 11 is a plan view showing yet another embodiment of this invention comprising two vertical cylinders.
Figure 12:
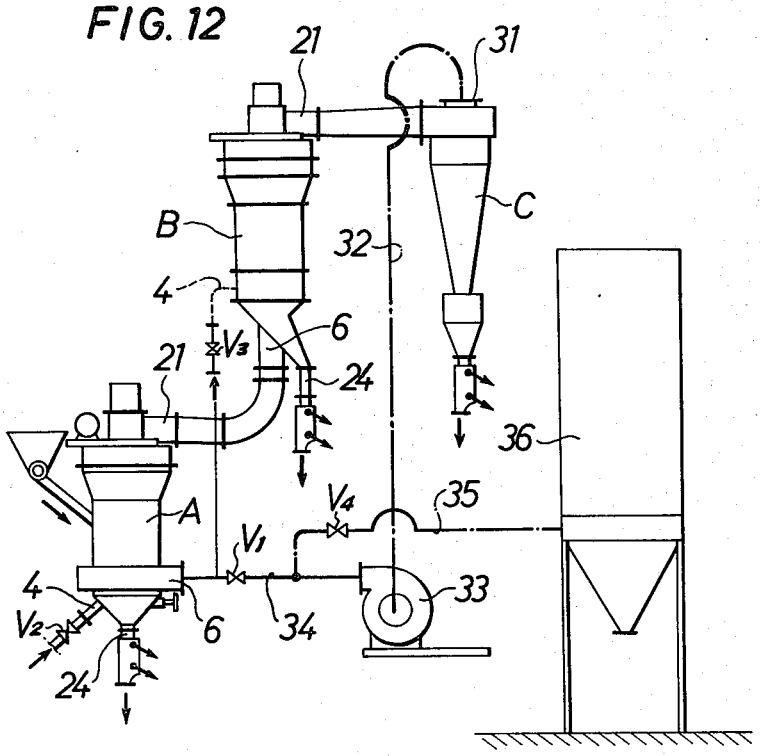
FIG. 12 is an enlarged side view of the embodiment shown in FIG. 11.

When a plurality of classifying apparatus shown in FIGS. 1 through 10 are combined, their utility can be increased greatly. Such embodiment is shown in FIGS. 11 and 12 in which two classifying apparatus A and B are used to operate in cascade. More particularly, the apparatus A separates coarse particles, and a mixture of air and fine particles is introduced into the bottom of the other classifying apparatus B. Where two classifying apparatus A and B are connected in cascade, at least the apparatus B should have a construction according to this invention, whereas the other apparatus A may have a construction of this invention or any other construction. With this modification, the particles are subjected to multi-stage classifying treatment without requiring any energy for supplying the mixture from one classifying apparatus to the other.

Whether a single classifying apparatus is used as shown in FIGS. 1~10 or two cascade connected classifying apparatus are used as shown in FIGS. 11 and 12, a mixture of air and fine particles discharged through a discharge pipe 21 is conveyed to such well known fine particle removing apparatus as a cyclone separator C. In this case the air discharged from the top opening 31 of the cyclone 31 is conveyed, through a pipe 32, to the inlet port of a blower 33 which supplies compressed air to the inlet pipe 6 of the other classifying apparatus A for creating the whirling upward flow. With this construction, the air is circulated through both classifying apparatus A and B. Where only one classification apparatus is used the air discharged from the cyclone is recirculated through the classifying apparatus. Although the fine particles discharged through the discharge pipe 21 can be separated by means other than a cyclone such as by a back filter or an electric precipitator, it was found that use of a cyclone in combination with a blower is most effective for stably establishing the required pressure condition (usually a negative pressure) in the classifying apparatus A and/or B. It was also found that, without the cyclone, the pressure in the classifying apparatus varys substantially depending upon the condition of supplying the particles to be classified i.e., their quality, quantity, etc. and upon the temperature condition, and that such variation in the internal pressure affects the classifying efficiency, whereas when the cyclone is incorporated it was confirmed that the pressure variation was decreased to about 1/10 or less, meaning stable and efficient classification can be made according to this embodiment.

In the embodiment shown in FIGS. 11 and 12 a back filter 36 is connected to a discharge pipe 34 of the blower 33 via a conduit 35 including a valve $V_4$ for removing fine particles floating in the circulating air, thus avoiding degradation of the classifying efficiency due to increase in the concentration of the fine particles in the circulating air.

Figure 13:
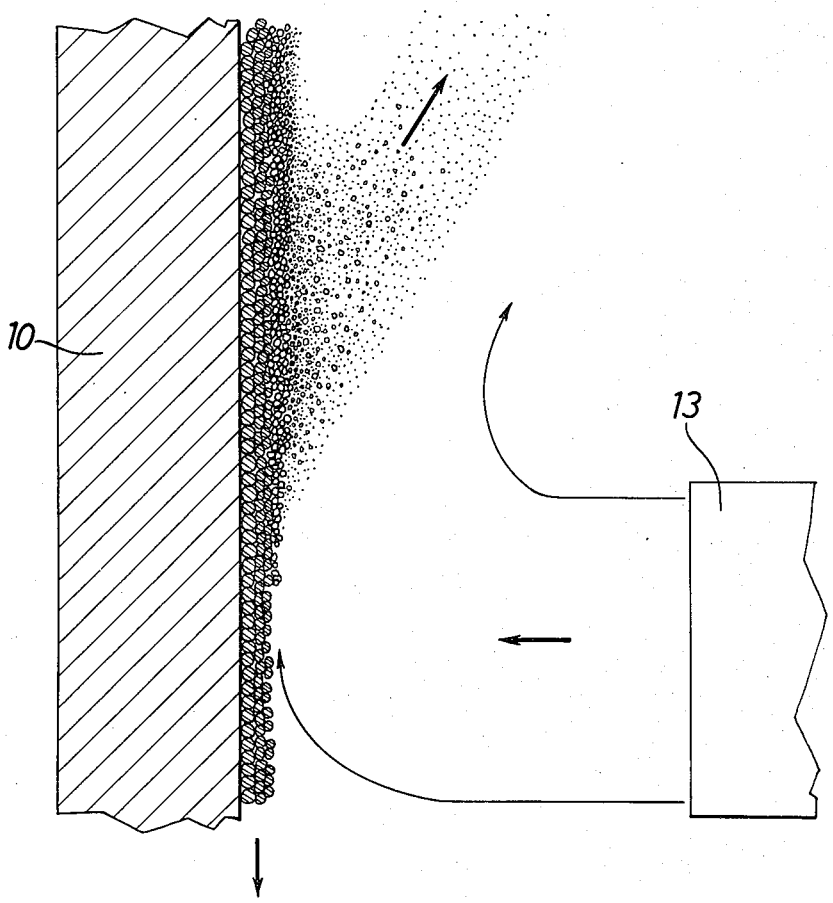
FIG. 13 is an enlarged sectional view useful to explain the interface layer separating effect of the coarse particle classifying mechanism on the wall surface of the cylindrical housing.

The operation of the classifying apparatus shown in FIGS. 1 through 10 will be described hereunder by using concrete data. The air supplied to the pipe under a pressure 10~20 mmHg is ejected by the nozzle for form a whirling upward flow in the housing 10. The particles introduced into the housing 10 together with the air generally form layers along the inner surface of the housing 10 as shown in FIG. 13 due to the whirling upward flow. Thus, the grain size gradually decreases from the inner surface of the housing 10 toward its central portion, and the deposited layers of the coarse particles fall down under the gravity. The air is ejected against the lower portions of the particle layers by the coarse particle classifying mechanism 13 as shown in FIG. 13. The quantity of the air ejected by the coarse particle classifying mechanism is smaller by ½ (preferably 10 to 30%) than that ejected from the nozzle 12, but the speed of the air ejected by the mechanism 13 is higher by 4~38% (preferably 6 to 32%) than that of the air ejected by the nozzle 12. Layers of the fine particles are separated and blown upwardly by the air ejected by the coarse particle classifying mechanism 13 and by the whirling upward flow created by the nozzle 12.

The mechanism of classifying fine particles has been well known in the art. More particularly, as the diameter of the upper portion of the housing 10 is increased as shown in FIG. 1, the speed of air is decreased so that coarser particles among blown up particles are projected against the inner wall of the enlarged diameter portion to deposit thereon. As the air flow projected by the coarse particle classifying mechanism is reflected inwardly and upwardly as shown by an arrow shown in FIG. 4 the speed of air flow near the inner wall of the housing 10 is lower than that in the central portion. Consequently, the coarser particles deposited on the inner wall of the enlarged diameter portion fall down and are discharged through the pipe 24.

In the embodiment shown in FIGS. 11 and 12, the quantities and speeds of the air ejected from the coarse particle classifying mechanism 13 and the whirling upward flow forming nozzle 12 can be adjusted to any desired values by adjusting valves $V_1$, $V_2$, $V_3$ and $V_4$. Preferred pressure conditions for a cascade connection of two classifying apparatus A and B are as follows.

in apparatus A: −5 mmHg
in apparatus B: <200 mmHg
in cyclon separator C: −550 mmHg
in conduit 32 leading to blower 33: −600 mmHg
in discharge conduit 34 of blower: +20 mmHg Of course, the pressure of the air circulating through the classifying apparatus A and B and the cyclone increases when the degree of opening of the valve $V_4$ included in the pipe 35 leading to the back filter 36 is decreased and vice versa.

As above described, since ejected air is utilized for classifying coarse particles, the construction of the apparatus can be simplified. Since the course particle classifying mechanism 13 of the present invention is designed as being stationery, the quantity and pressure of the ejected air do not change so that the layers of the deposited particles are separated and fall down. Moreover, as the particles to be classified are supplied to a whirling upward flow forming device together with air supplied thereto no independent device is required for dispersing the particles to be classified in the apparatus which also simplifies the construction. Moreover, as there is no member that interferes or prevents the whirling upward flow, the efficiency of separation of the coarser particles in the region of the whirling upward flow can be improved. Where two or more classifying apparatus are cascade connected, not only the apparatus for supplying particles to be classified can be simplified, but also it is possible to classify the particles into 3 or more classes according to their particle size.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed:

1. A particle classifying apparatus comprising:

(a) a vertical cylindrical housing comprising a side wall defining an inner surface and having an upper portion and a lower portion;

(b) a first pipe means for introducing into said housing air containing particles to be classified;

(c) a nozzle means provided in said lower portion of said housing and connected to an upper end of said first pipe means for converting said air containing said particles into an upward whirling flow;

(d) means provided in said upper portion of said housing for separating fine particles from said upward whirling flow and discharging said particles out of said housing through an upper opening with remaining particles, mainly consisting of coarse particles and containing some fine particles which have not been separated by said fine particle separating means, descending along said inner surface of said housing; and (e) a second stationary pipe means extending into said housing through said side wall thereof beneath said nozzle means, said pipe means terminating as an outlet spaced from said side wall and directed at said side wall, said pipe means injecting air which is subsequently ejection against said inner surface of said housing, thereby separating and blowing upwardly fine particles present in said descending particles effecting further particle classification, the remaining coarse particles descending along said inner surface of said housing and being discharged out of said housing through a lower opening.

2. The particle classifying apparatus according to claim 1 further comprising a distribution chamber communicating with said outlet of said second pipe means, and means for introducing tangentially air into said distribution chamber, said distribution chamber being eccentrically disposed with respect to said first stationary pipe means, the radial sectional area of said distribution chamber decreasing gradually starting from a point at which said air is tangentially introduced into said distribution chamber such that the air whirls in said distribution chamber and then is radially blown outwardly through an annular opening connected to an upper periphery of said distribution chamber, said eccentric arrangement insuring uniform discharge of air throughout the entire periphery of said distribution chamber.

3. Particle classifying apparatus according to claim 1 wherein at least two classifying apparatus are connected in cascade, and at least one of said classifying apparatus is constructed as defined in claim 1.

4. The apparatus according to claim 1 having a diameter of said upper portion of said vertical cylindrical housing larger than that of said lower portion, and said fine particle separating means is contained in said upper portion.

5. The particle classifying apparatus according to claim 1, wherein said whirling upward flow forming nozzle means comprises a top plate mounted above the upper end of said vertical pipe means, a horizontal lower plate parallel to said top plate secured to the upper end of said first stationary pipe means, and a plurality of circumferentially spaced guide vanes interposed between said top plate and said horizontal lower plate.

6. The particle classifying apparatus according to claim 5 wherein said guide vanes are inclined with respect to the radial direction.

7. The particle classifying apparatus according to claim 5 wherein said guide vanes are inclined with respect to a center axis of said vertical housing.

8. The particle classifying apparatus according to claim 5 wherein said guide vanes are parallel with respect to a center axis of said vertical housing.

9. The particle classifying apparatus according to claim 1 wherein said means provided for injecting air which is injected against the inner surface of said housing includes a means for adjusting the quantity of air supplied such that it is less than one half of that of the air supplied to said nozzle means and for adjusting the flow speed of said air ejected against the inner surface of said cylindrical housing to be greater by 4 to 38% than the speed of said whirling upward air flow.

10. The particle classifying apparatus according to claim 9 which further comprises a plurality of circumferentially spaced guide vanes associated with said distribution chamber.

11. The particle classifying apparatus according to claim 9, wherein said whirling upward flow forming nozzle means comprises a top plate mounted above the upper end of said first stationary pipe means, a horizontal lower plate parallel to said top plate secured to the upper end of said first stationary pipe means, and a plurality of first circumferentially spaced guide vanes interposed between said top plate and said horizontal lower plate and a plurality of second circumferentially spaced guide vanes provided for said coarse particle classifying means, said second guide vanes inclining in the same direction as said first guide vanes provided for said whirling upward flow forming nozzle means.

12. The particle classifying apparatus as defined in claim 1 which further comprises a cyclone cionnected to the upper portion of said cylindrical housing for receiving air containing said remaining fine particle to remove the same.

13. The particle classifying apparatus according to claim 12 which further comprises blower means for supplying the air subsequently discharged from said cyclone to said first stationary pipe means thereby recirculating the air through said particle classifying apparatus from said cyclone.

14. The particle classifying apparatus according to claim 13 which further comprises a back filter connected to a pipe extending between said blower means and said first stationary pipe means, and a valve for controlling a quantity of air supplied to said back filter.

* * * * *